US005316530A

United States Patent [19]

Römer

[11] Patent Number: 5,316,530

[45] Date of Patent: May 31, 1994

[54] DOWNHILL-SKI TRAINING APPARATUS

[76] Inventor: Detlef Römer, Am Kirchlöh 2, W-5970 Plettenberg, Fed. Rep. of Germany

[21] Appl. No.: 46,006

[22] Filed: Apr. 9, 1993

[30] Foreign Application Priority Data

Apr. 11, 1992 [DE] Fed. Rep. of Germany ..... 4212239

[51] Int. Cl.[5] ..... A63B 69/18

[52] U.S. Cl. ..... 482/71; 482/130; 482/51

[58] Field of Search ..... 482/71, 79, 51, 146, 482/147, 123, 129, 130; 434/253

[56] References Cited

U.S. PATENT DOCUMENTS

| | | | |
|---|---|---|---|
| 4,607,839 | 8/1986 | Knodson | 482/71 |
| 4,869,496 | 9/1989 | Colombo | 482/71 |

FOREIGN PATENT DOCUMENTS

| | | | |
|---|---|---|---|
| 0280118 | 3/1970 | Austria | 482/71 |
| 0632029 | 12/1961 | Canada | 482/71 |
| 1570143 | 6/1969 | France | 482/71 |
| 067309 | 2/1990 | Switzerland | 482/71 |
| 1175511 | 8/1985 | U.S.S.R. | 482/71 |
| 0834105 | 5/1960 | United Kingdom | 482/71 |

*Primary Examiner*—Richard J. Apley
*Assistant Examiner*—Lynne A. Reichard
*Attorney, Agent, or Firm*—Herbert Dubno; Andrew Wilford

[57] ABSTRACT

A downhill-ski training apparatus has a pair of like elongated ski beams each having a rear end carrying a respective foot pads and a front end connected to a stationary base at a swivel for movement of each the beams on the base about a respective vertical axis and a respective generally horizontal axis generally parallel to the respective beam so that each beam can be pivoted about its respective vertical axis from a center position with its rear end on a central region of a track to two flanking side positions with its rear end on side regions of the track. Respective elongated elastically extensible spring elements each have a rear end fixed to the rear end of the respective beam and a front end to the front side of the base and a middle part extending around a deflecting member that urges the beams toward the respective center positions and resists movement into the side positions with a force increasing as distance from the center position increases. Respective fixed-length links extend between a location offset on the respective beam from the respective horizontal and vertical axes and another end fixed to the base. The links are oriented such that on pivoting of the respective beams into the side positions the beams are tipped about their horizontal axes to an extent generally proportional to the angle of deflection from the respective center positions.

18 Claims, 7 Drawing Sheets

DOWNHILL-SKI TRAINING APPARATUS

FIELD OF THE INVENTION

The present invention relates to a ski training apparatus. More particularly this invention concerns a downhill-ski training apparatus or simulator.

BACKGROUND OF THE INVENTION

A downhill ski simulator is known which has a pair of footpads mounted at the rear ends of respective ski-like beams pivoted at their front ends about upright axes. The rear ends can ride on an arcuate track and springs urge the beams into a central parallel position. Thus the user, in order to simulate the side-to-side action of downhill skiing, stands on the pads and pushes the beams to one side and then the other against the resistance of the springs, strengthening the necessary muscle groups.

The main disadvantage of such devices is that they do not accurately simulate the movement and work of downhill skiing. The two ski beams are not capable of moving independently of each another and of pivoting about their own axes independently of each other like real skis. Neither do them meet the different levels of resistance that skis meet under actual downhill conditions, that is with the outer ski in a turn doing most of the work.

Thus a person training with such an apparatus can develop habits that will have to be unlearned once out on the slopes, and that might even make him or her a less able skier.

OBJECTS OF THE INVENTION

It is therefore an object of the present invention to provide an improved downhill simulator or ski-training apparatus.

Another object is the provision of such an improved downhill simulator or ski-training apparatus which overcomes the above-given disadvantages, that is which accurately reproduces the conditions of downhill skiing, in particular during turns.

SUMMARY OF THE INVENTION

A downhill-ski training apparatus has according to the invention a base having a front side and a back side, an arcuate track fixed on the back side of the base and having an elevated central region and a pair of downsloping side regions symmetrically flanking the central region, and a pair of like elongated ski beams each having a front end at the front side and a rear end riding on the track at the rear side. Respective foot pads support a user's feet on the rear beam ends and respective front pivots couple the front beam ends to the front side of the base for movement of each the beams on the base about a respective vertical axis and a respective generally horizontal axis generally parallel to the respective beam so that each beam can be pivoted about its respective vertical axis from a center position with its rear end on the central region of the track to two flanking side positions with its rear end on the respective side regions of the track with the skis normally moving together and one of the skis always lying outside the other. Respective elongated elastically extensible spring elements each have a rear end fixed to the rear end of the respective beam and a front end to the front side of the base. At least one deflecting member engageable with the spring elements between their ends urges the beams toward the respective center positions and resists movement into the side positions with a force increasing as distance from the center position increases so that outward displacement of the outside ski will be resisted with substantially greater force than outward displacement of the inside ski. Respective fixed-length links each having one end fixed to the respective beam at a location offset thereon from the respective horizontal and vertical axes and another end fixed to the base each extend transversely of the respective horizontal and vertical axes. The links are oriented such that on pivoting of the respective beams into the side positions the beams are tipped about their horizontal axes to an extent generally proportional to the angle of deflection from the respective center positions.

Thus with this system the action of real downhill skiing, mainly during turns, is accurately emulated. The outside ski, which is the one doing 80% of the work in a turn, is subjected to 80% of the total spring force, while the inside ski only gets 20%. Furthermore as the skis move to the side they tip in the manner necessary for a skier to get up on his or her edges to maintain control in a turn. The result is extremely effective training that prepares a skier realistically for actual work on the slope.

According to a feature of the invention the beams are round-section tubes generally centered on the respective horizontal axes and the front ends of the tubes are provided with swivels securing them to the base. The base has a pair of side bars extending at about 90° to each other, a front bar bridging front ends of the side bars, and a back bar bridging back ends of the side bars, carrying the track, and extending parallel to the front side. In addition the base is provided with at least one upright supporting a pair of handles generally above the front side. Each beam is provided on its rear end with a roller rotatable about the respective horizontal axis and riding on the track. The spring-element front ends are secured to the base between the front pivots and extend in the center positions of the beams generally parallel to the beams.

In accordance with the invention the deflecting member is adjustable front-to-back on the base and the spring elements are engaged with the deflecting member. This makes it possible to vary the spring force for the strength of the person training on the apparatus. The deflecting member includes at least one upright deflecting post around which the spring elements extend. Furthermore this deflecting member can include a pair of relatively closely transversely spaced front posts each engaging a respective one of the spring elements, and a pair of relatively widely transversely spaced rear posts each engaging the respective spring element. In this case the deflecting member includes a mounting plate to which all the posts are fixed and means for securing the mounting plate in any of a multiply of positions offset front to back on the base. The base is generally symmetrical about an upright plane that is equidistant between the beams in the center positions thereof. The defecting member is symmetrical with respect to the plane.

Each fixed-length pivot according to the invention is provided at its one end with a swivel above and connected to the respective mean and is connected at its other end at a swivel to the front side of the base. These fixed-length links are each adjustable as to length. In addition a spacer element is engaged between the rear ends of the beams and maintains same at a predetermined minimal spacing while, of course, permitting the skis to move apart out of parallel.

To monitor training effectiveness a sensor associated with each beam detects the force exerted thereon by the user, and a controller connected to the sensor emits a signal when in a side position of the ski beams the inside ski beam is subjected to an excessive force by the user. Furthermore another sensor detects the position of the ski beams relative to each other, and the controller emits a signal when it senses that the skis are excessively out of parallel with each other. In addition each foot pad is slightly pivotal on the respective beam about a pad axis transverse to the respective beam horizontal axis and generally parallel to the respective foot pad. Another sensor detects tipping of the foot pad about the respective pad axis on the respective beam, and the controller emits a signal when it senses that the respective pads are excessively tipped relative to the respective beam. Thus whenever the person on the apparatus starts using bad form, an alarm will be sounded to advise him or her to make a correction.

BRIEF DESCRIPTION OF THE DRAWING

The above and other objects, features, and advantages will become more readily apparent from the following, reference being made to the accompanying drawing in which:

FIG. 1 is a top view of the apparatus according to the invention;

SPECIFIC DESCRIPTION

Figure 7:
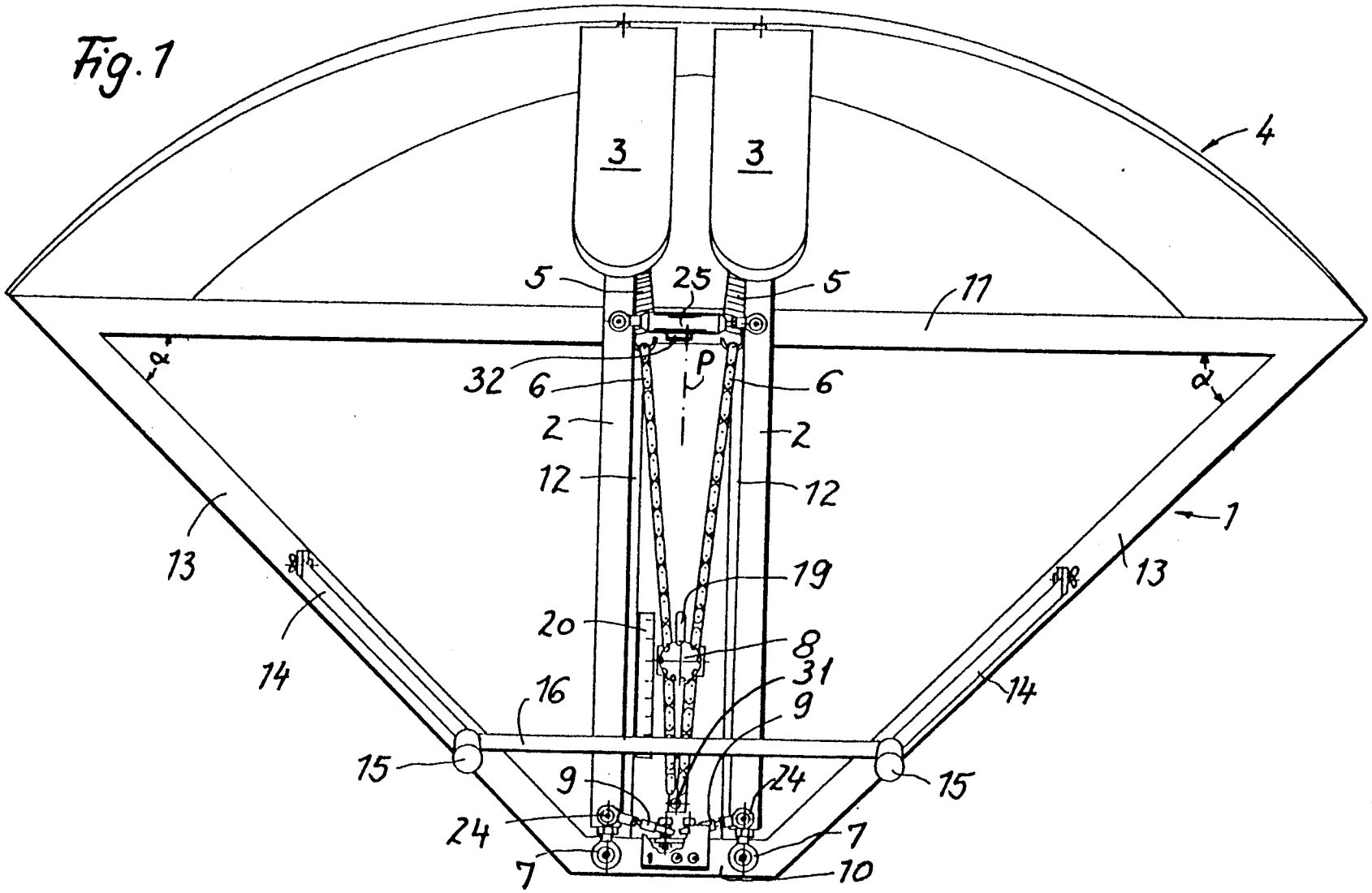
FIG. 7 is a large-scale partly sectional view of a detail of the apparatus.
Figure 2:
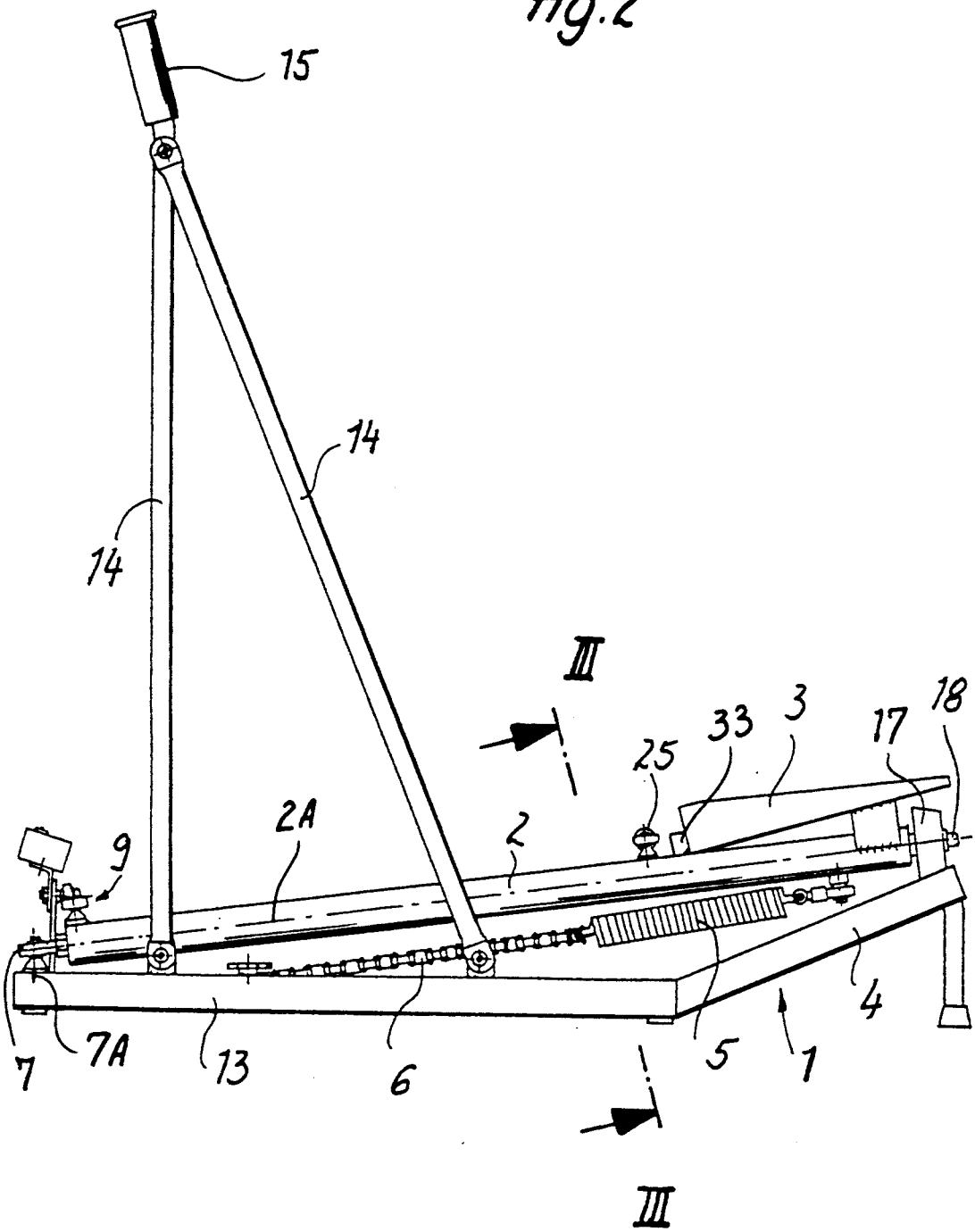
FIG. 2 is a side view of the apparatus.

As seen in FIGS. 1 through 4, a downhill simulator according to this invention has a base 1 adapted to sit on the floor and formed by a pair of side bars 13 extending at a 90° angle to each other, a short front bar 10, and a long back bar 11 extending parallel to the front bar 10 and at an angle $\alpha$ of 45° to the side bars 13. An arcuate track 4 having a center of curvature at the front bar 10 and a raised center part (See FIG. 3.) is fastened to the rear side of the base 1 at the corners where the side bars 13 and rear bar 11 meet. Front-to-back struts 12 flanking a central upright symmetry plane P stiffen the base 1.

A pair of substantially identical cylindrically tubular ski beams 2 each about 1 m long are secured at a front-end pivot 7 to the base 1 at the front bar 10 for two degrees of freedom, namely pivoting about a respective vertical axis 7A and twisting about a generally horizontal longitudinal axis 2A corresponding to the longitudinal axis of the beam 2. Each beam 2 carries on its rear end a shaft 18 extending coaxial with the respective axis 2A and supporting a frustoconical wheel 17 of rubber material riding on the track 4, and also directly over each wheel 17 a foot pad 3 adapted to support a respective foot of the user of the machine.

A pair of upright struts 14 on each side bar 13 carry at their upper ends a handle 15 and a crosspiece 16 parallel to the front bar 10 interconnects these handles 15 and stabilizes this handle assembly. The user holds these handles 14 while standing on the foot pads 3, treating the handles like ski poles. An experienced skier could use standard ski poles, in which case the assembly 14–16 would be unbolted and removed.

Each beam 2 is attached at its rear end to the rear end of a respective coil tension spring 5 whose front end is attached via an inflexible chain element 6 to an anchor location 31 on the front bar 10 equidistant between the pivots 7. The total lengths of the spring assemblies 5, 6 are the same so that they urge the two beams into the central position illustrated in FIG. 1. Both elements 6 pass through a deflector 8 that is adjustable front-to-back on a fixed mount 19 relative to a scale 20 and that is always spaced somewhat rearward of the pivots 7, or of a vertical plane defined by the axes 7A. The farther back the deflector 8, the greater the resistance to lateral deflection of the beams 2.

Figure 4:
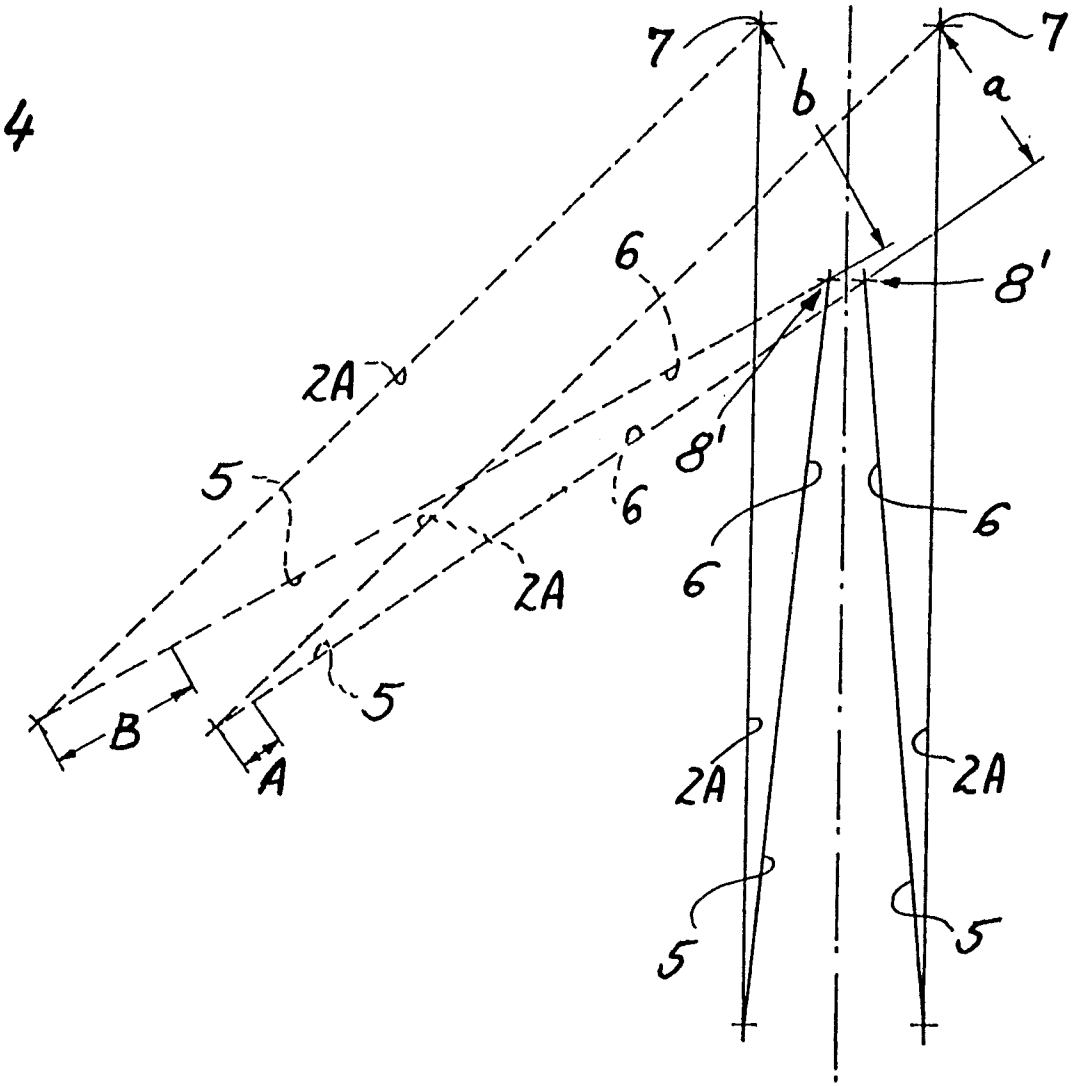
FIG. 4 is a diagram illustrating how the apparatus works.

The rearward spacing of the deflector 8 from the pivots 7 ensures as shown in FIG. 4 that, when the ski beams 2 are deflected to one side or the other, the spring 5 of the outer beam 2 will be stretched more than the spring 5 of the inner beam 2, in FIG. 4 the left-hand and right-hand beams 2, respectively. More particularly, when deflected to the left as illustrated a distance a measured perpendicular to the axis 2A of the inner beam 2 between the respective pivot 7 and the point 8' on the deflector 8 where the respective element 6 is deflected is substantially smaller than a corresponding distance b for the outer beam, because the points 8' are spaced apart in a direction parallel to the plane of the axes 7A. Thus the inner spring 5 will be stretched to a relatively short extent A while the outer spring 6 will be stretched to a much greater extent B. The result is therefore that the spring 5 will try to pull the outer ski beam back with much greater force, typically about four times greater, than the spring 5 of the inner beam. This accurately reproduces actual skiing conditions where the outer foot takes most of the load in a turn.

Furthermore according to the invention a fixed-length link 9 is fixed between an outer end on each beam 2 at a swivel pivot 24 thereon which is spaced rearward of the respective axis 7A and upward of the respective axis 2A and at an inner end roughly on the above-mentioned anchor location 31 where the ends of the elements 6 are secured. These links 9 extend nearly perpendicular to the respective axes 2A in the illustrated central position. In order to be able to adjust the footpads 3 to a perfectly vertical position when in the center position, the length of the links 9 can be varied and fixed within a certain range.

Figure 3:
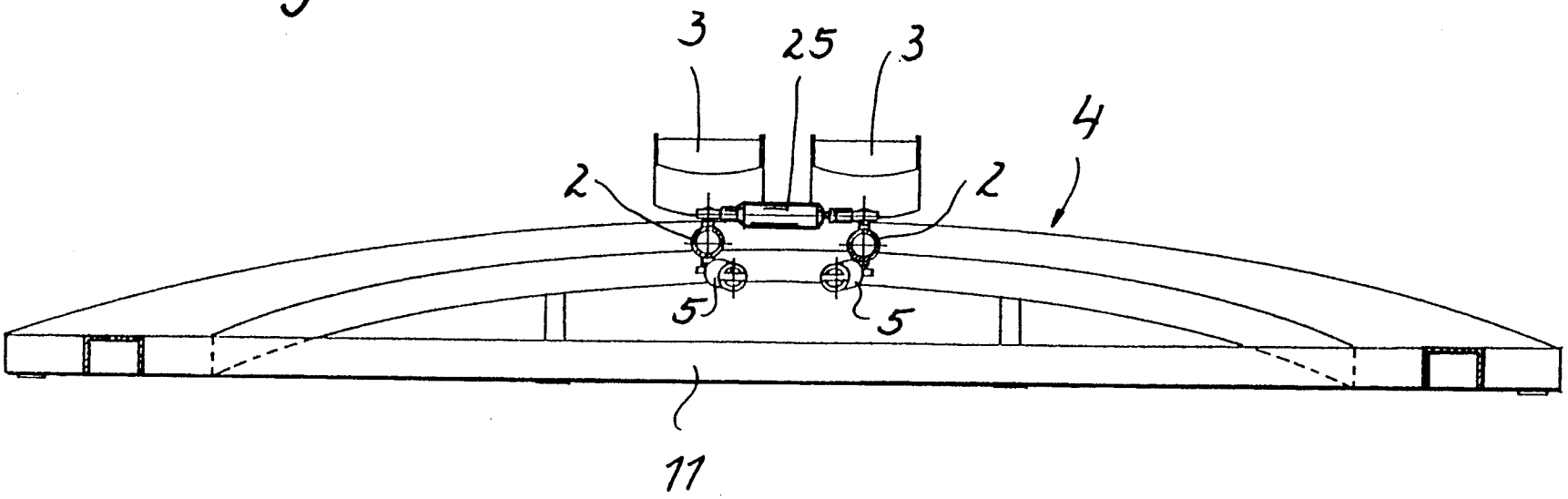
FIG. 3 is a section taken along line III—III of FIG. 2.

When, for instance, the beams 2 are pivoted to the right as seen in FIGS. 1 and 3, the links 9 will twist the beams 2 counterclockwise as seen in FIG. 3 about their axes 2A, thereby tipping the foot pads 3 inward. Once again this accurately reproduces what should happen when a skier pushes off to the side in a turn, getting up on his or her edges, and forces the skier to accustom him or herself to this position. Opposite pivoting oppositely twists the beams, accurately reproducing the right position for an opposite turn.

Figure 5:
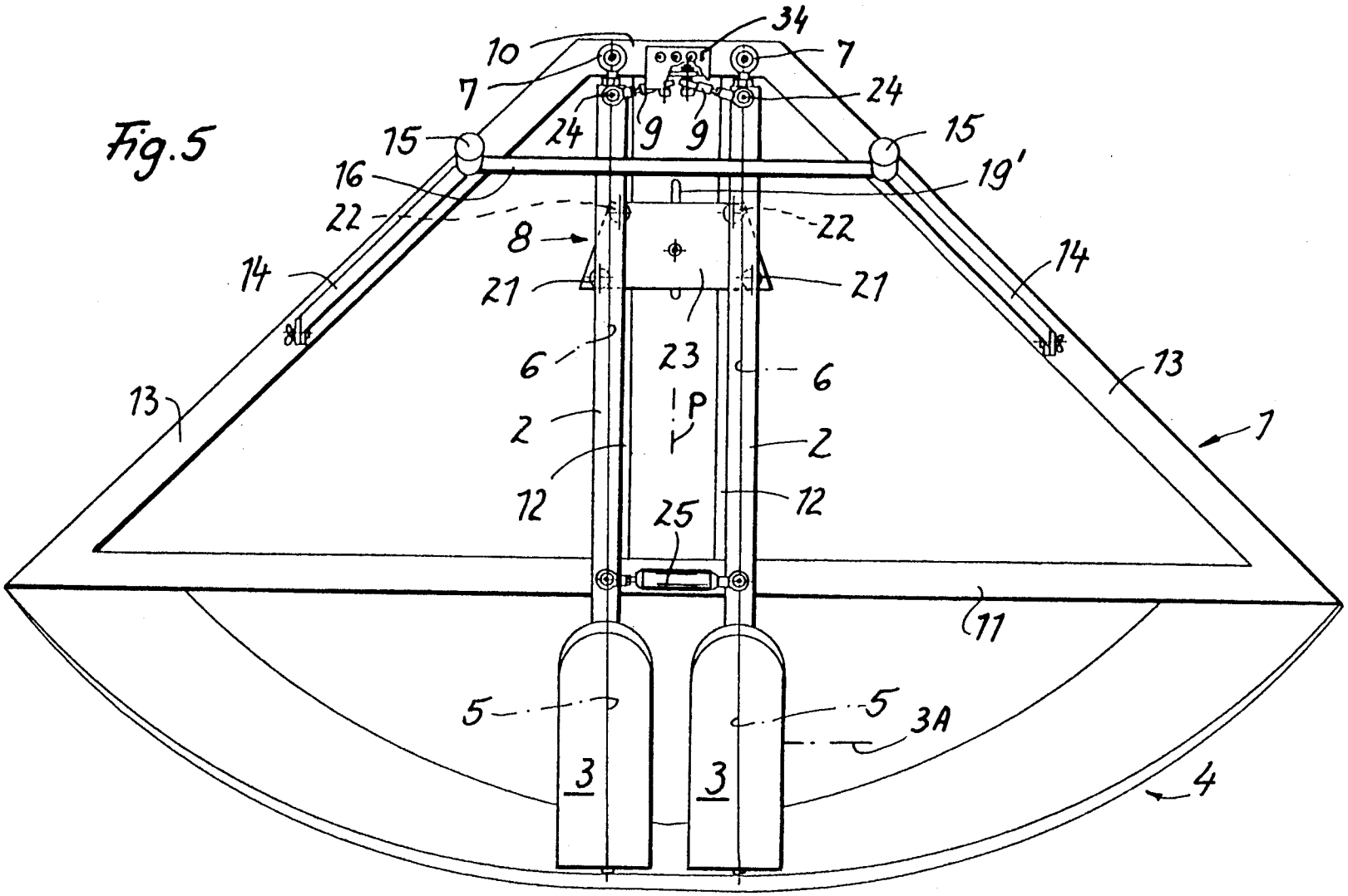
FIGS. 5 and 6 are views like respective FIGS. 1 and 4 showing an alternative arrangement according to the invention.
Figure 6:
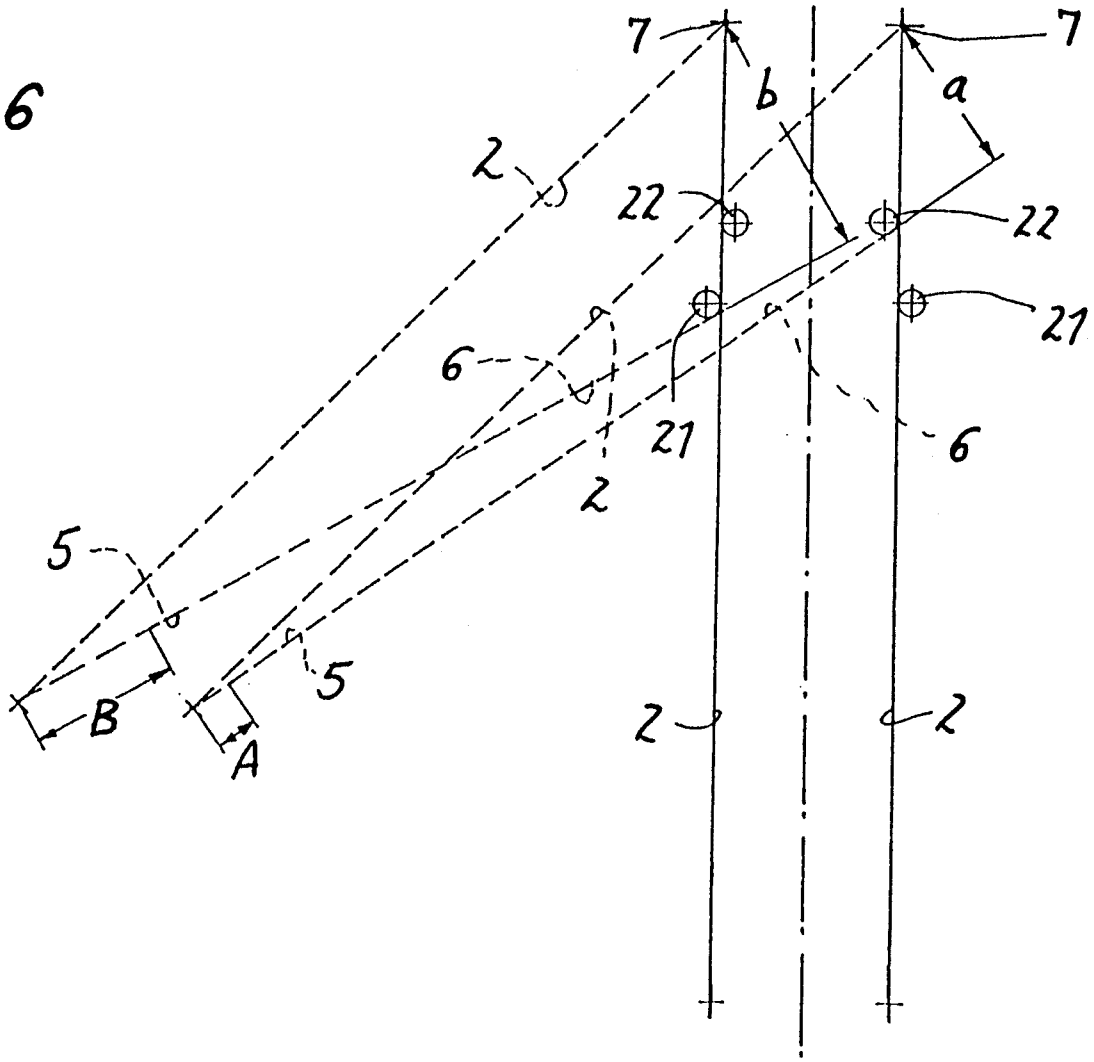
Figure 7:
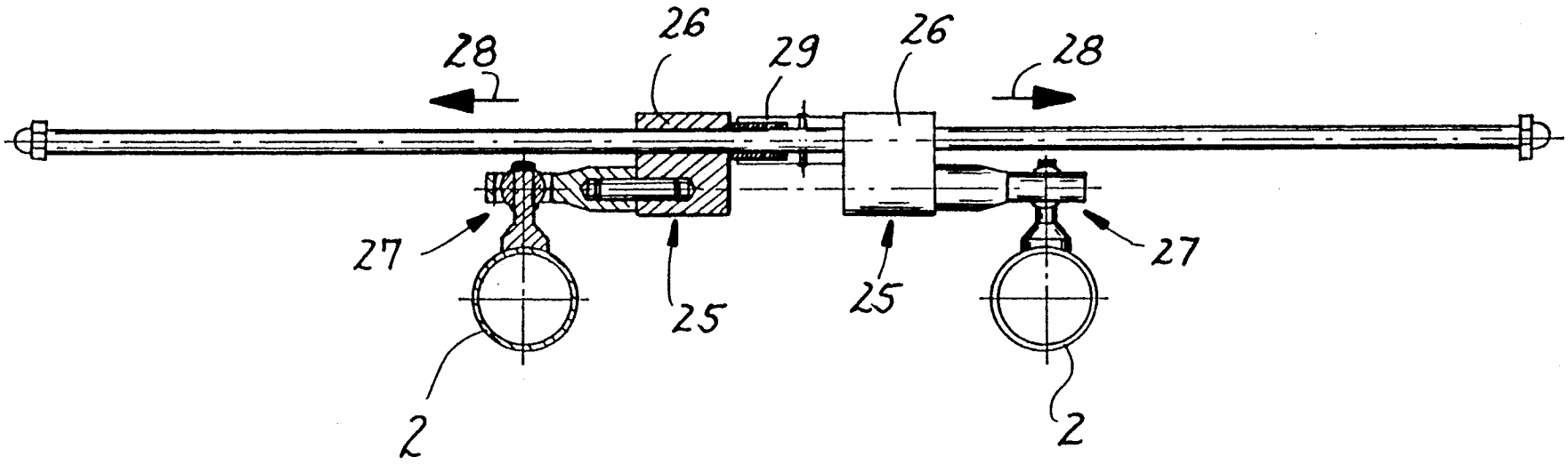

FIGS. 5 shows an alternative arrangement where a plate 23 which can be secured anywhere along a front-to-back slot 19' in the base 1 carries a pair of upstanding front deflector posts 22 that are relatively closely spaced and a pair of upstanding rear deflector posts 21 that are somewhat more widely spaced. The posts 21 and 22 symmetrically flank the central symmetry plane P of the apparatus. FIG. 6 shows how the spring elements are passed outside the front posts 22 and inside the front posts 21 so that when the beams 2 are deflected to either side the spring of the outer ski beam is stretched more than the spring of the inner ski beam, causing the outer beam to meet substantially more resistance than the inner one as described above.

In addition the rear ends of the beams 2 are loosely interconnected by a variable-length spacer assembly 25 shown in some detail in FIG. 7. It comprises two slide blocks 26 each secured with two degrees of freedom of movement via a swivel or ball joint 17 on a respective one of the tubular beams 2 and both riding on a transverse slide rod 30. This rod 30 is provided centrally with a fixed stop 29 that permits the two slide blocks 26 to move as shown by arrows 28 away from this stop 29. This stop 29 also acts as a spacer that prevents the two beams 2 from getting too close to each other, into a position where they could trip up the user. The spacer 25 permits the beams to move apart by about 20° so that the user must also work to keep his or her "skis" parallel. In other words, as in real skiing the user must work to keep his or her feet parallel; they are not automatically and artificially maintained parallel as in some prior-art such trainers.

This element 25 carries a sensor 32 connected to a controller/display 34 that emits a signal when the two skis beams 2 are too far out of parallel or the inner ski is pushed with excessive force. Another such strain-gauge sensor 33 is provided under each foot pad 3 and is connected to the controller/display 34 to indicate if the respective foot pad 3, which is set up so it can tip limitedly on the respective beam about an axis 3A, is being urged pivotally about its axis 3A with excessive force. The actual pivoting about the axis 3A can be limited to very little, for instance 0.5 mm. The system is set up to emit an alarm if the skier has too much weight on his or her heels.

I claim:

1. A downhill-ski training apparatus comprising:

a base having a front side and a back side;

an arcuate track fixed on the back side of the base and having an elevated central region and a pair of down-sloping side regions symmetrically flanking the central region;

a pair of like elongated ski beams each having a front end at the front side and a rear end riding on the track at the rear side;

respective foot pads adapted to support a user's feet on the rear beam ends;

respective front pivots coupling the front beam ends to the front side of the base for movement of each the beams on the base about a respective vertical axis and a respective generally horizontal axis generally parallel to the respective beam, whereby each beam can be pivoted about its respective vertical axis from a center position with its rear end on the central region of the track to two flanking side positions with its rear end on the respective side regions of the track with the beams normally moving together and one of the beams always lying outside the other;

respective elongated elastically extensible spring elements each having a rear end fixed to the rear end of the respective beam and a front end to the front side of the base;

means including at least one deflecting member engageable with the spring elements between their ends for urging the beams toward the respective center positions and for resisting movement into the side positions with a force increasing as distance from the center position increases, whereby outward displacement of the outside ski will be resisted with substantially greater force than outward displacement of the inside ski; and respective fixed-length links each having one end fixed to the respective beam at a location offset thereon from the respective horizontal and vertical axes and another end fixed to the base and each extending transversely of the respective horizontal and vertical axes, the links being oriented such that on pivoting of the respective beams into the side positions the beams are tipped about their horizontal axes to an extent generally proportional to the angle of deflection from the respective center positions.

2. The downhill training apparatus defined in claim 1 wherein the beams are round-section tubes generally centered on the respective horizontal axes.

3. The downhill training apparatus defined in claim 1 wherein the front ends of the tubes are provided with swivels securing them to the base.

4. The downhill training apparatus defined in claim 1 wherein the base has a pair of side bars extending at about 90° to each other, a front bar bridging front ends of the side bars, and a back bar bridging back ends of the side bars, carrying the track, and extending parallel to the front side.

5. The downhill training apparatus defined in claim 4 wherein the base is provided with at least one upright supporting a pair of handles generally above the front side.

6. The downhill training apparatus defined in claim 1 wherein each beam is provided on its rear end with a wheel rotatable about the respective horizontal axis and riding on the track.

7. The downhill training apparatus defined in claim 1 wherein the spring-element front ends are secured to the base between the front pivots and extend in the center positions of the beams generally parallel to the beams.

8. The downhill training apparatus defined in claim 7 wherein the deflecting member is adjustable front-to-back on the base and the spring elements are engaged with the deflecting member.

9. The downhill training apparatus defined in claim 8 wherein the deflecting member includes at least one upright deflecting post around which the spring elements extend.

10. The downhill training apparatus defined in claim 8 wherein the deflecting member includes a pair of relatively closely transversely spaced front posts each engaging a respective one of the spring elements, and a pair of relatively widely transversely spaced rear posts each engaging the respective spring element.

11. The downhill training apparatus defined in claim 10 wherein the deflecting member includes a mounting plate to which all the posts are fixed and means for securing the mounting plate in any of a multiply of positions offset front to back on the base.

12. The downhill training apparatus defined in claim 8 wherein the base is generally symmetrical about an upright plane that is equidistant between the beams in the center positions thereof, the defecting member being symmetrical with respect to the plane.

13. The downhill training apparatus defined in claim 1 wherein each fixed-length link is provided at its one end with a swivel above and connected to the respective beam is connected at its other end at a swivel to the front side of the base.

14. The downhill training apparatus defined in claim 13 wherein the fixed-length links are each adjustable as to length.

15. The downhill training apparatus defined in claim 1, further comprising a spacer element engaged between the rear ends of the beams and maintaining same at a predetermined minimal spacing.

16. The downhill training apparatus defined in claim 1, further comprising a sensor associated with each beam for detecting the force exerted thereon by the user; and control means connected to the sensor for emitting a signal when in a side position of the ski beams the inside ski beam is subjected to an excessive force by the user.

17. The downhill training apparatus defined in claim 1, further comprising a sensor for detecting the position of the ski beams relative to each other; and means connected to the sensor for emitting a signal when it senses that the skis are excessively out of parallel with each other.

18. The downhill training apparatus defined in claim 1 wherein each foot pad is slightly pivotal on the respective beam about a pad axis transverse to the respective beam horizontal axis and generally parallel to the respective foot pad, the apparatus further comprising:

means including a sensor for detecting tipping of the foot pad about the respective pad axis on the respective beam; and means connected to the sensors for emitting a signal when it senses that the respective pads are excessively tipped relative to the respective beam.

* * * * *